US008187385B2

(12) United States Patent
Nakagame et al.

(10) Patent No.: US 8,187,385 B2
(45) Date of Patent: May 29, 2012

(54) CONVEYING UNIT AND VACUUM DEPOSITION DEVICE

(75) Inventors: Masami Nakagame, Odawara (JP); Hiroyuki Nishida, Odawara (JP); Hideaki Takeuchi, Odawara (JP)

(73) Assignee: FUJIFILM Corporation, Tokyo (JP)

( * ) Notice: Subject to any disclaimer, the term of this patent is extended or adjusted under 35 U.S.C. 154(b) by 609 days.

(21) Appl. No.: 12/363,246

(22) Filed: Jan. 30, 2009

(65) Prior Publication Data

US 2009/0188961 A1 Jul. 30, 2009

(30) Foreign Application Priority Data

Jan. 30, 2008 (JP) ..... 2008-018812

(51) Int. Cl.
*C23C 16/00* (2006.01)
*C23C 14/00* (2006.01)

(52) U.S. Cl. ..... 118/718; 204/298.24

(58) Field of Classification Search ..... 118/718; 204/298.24

See application file for complete search history.

(56) References Cited

U.S. PATENT DOCUMENTS

| | | | | |
|---|---|---|---|---|
| 6,427,941 | B1 | 8/2002 | Hikita | |
| 2004/0074443 | A1 * | 4/2004 | Madocks | 118/718 |
| 2007/0281089 | A1 * | 12/2007 | Heller et al. | 427/255.5 |

FOREIGN PATENT DOCUMENTS

| | | | |
|---|---|---|---|
| JP | 61211832 A | * | 9/1986 |
| JP | 09-222677 A | | 8/1997 |
| JP | 2000-86032 A | | 3/2000 |
| JP | 2001-106402 A | | 4/2001 |
| JP | 2004087792 A | * | 3/2004 |

OTHER PUBLICATIONS

Notification of Reasons for Refusal, dated Dec. 6, 2011, issued in corresponding JP Application No. 2008-018812, 8 pages in English and Japanese.

* cited by examiner

*Primary Examiner* — Karla Moore
(74) *Attorney, Agent, or Firm* — Sughrue Mion, PLLC

(57) ABSTRACT

The conveying unit conveys a long sheet-like subject in its longitudinal direction. The conveying unit includes a stepped roller which has large-diameter portions spaced apart from each other in a direction perpendicular to a direction of conveyance of the sheet-like subject and having a larger diameter than a remainder of the stepped roller being a small-diameter portion of the stepped roller, the large-diameter portions supporting and conveying the sheet-like subject, a closed space forming subunit between the small-diameter portion of the stepped roller and the sheet-like subject and a gas supply subunit for supplying a gas to the closed space. The vacuum deposition device forms a film on a surface of a long substrate by vacuum deposition. The vacuum deposition device includes a vacuum chamber, a conveying device which includes the conveying unit and a film forming unit.

12 Claims, 3 Drawing Sheets

CONVEYING UNIT AND VACUUM DEPOSITION DEVICE

The entire contents of a literature cited in this specification are incorporated herein by reference.

BACKGROUND OF THE INVENTION

This invention relates to conveyance of a long sheet-like subject (hereinafter simply referred to as the "sheet"). More specifically, this invention relates to a conveying unit capable of reducing damage to a sheet due to friction or other defect and a vacuum deposition device employing such conveying means.

Various functional films (functional sheets) including gas barrier films, protective films, and optical films such as optical filters and antireflection films are used in various devices including optical devices, display devices such as liquid crystal displays and organic EL displays, semiconductor devices, and thin film solar batteries.

These functional films have been formed by film formation (thin film formation) through vacuum deposition techniques such as sputtering and plasma CVD.

Continuous deposition of a film on a long strip of substrate is preferable for efficient film formation with high productivity.

A typical device known in the art for conducting such film formation is a roll-to-roll film deposition device using a feed roll having a long strip of substrate (a web of substrate) wound into a roll and a take-up roll in which the substrate having a film formed thereon is wound into a roll. This roll-to-roll film deposition device continuously forms a film on a long strip of substrate in the film deposition chamber while conveying the substrate from the feed roll to the take-up roll along a predetermined pathway passing through the film deposition chamber where the film is formed on the substrate by plasma CVD. In this device, the substrate is fed from the feed roll in synchronism with the winding of the substrate having the film formed thereon on the take-up roll.

Rollers are used to convey a long sheet not only in such a roll-to-roll film deposition device but also in a device for winding a produced plastic film and a device for producing a magnetic recording medium.

As a matter of course, conveyor means such as a roller is required to convey a sheet without causing damage thereto. However, differences between the rotational speed of the roller and the speed of a sheet due to variations in the rotational speed and conveying speed and variations in the tension of the sheet cause the sheet to come in sliding contact with the roller, which may cause damage to the sheet such as scratches on the sheet surface. In cases where the sheet has a flexible organic film formed on its surface, the pressing force with which the roller presses the sheet may cause damage to the sheet to deteriorate its surface properties.

In the case of, for example, an optical film, the damage to the sheet and the deterioration of the surface properties may cause light to diffuse or scatter and the resulting product will not proper.

If a sheet has damage to its surface or deteriorated surface properties in forming a film on the surface of the sheet by vacuum deposition, proper crystal growth is hindered, making it impossible to deposit a thin film having desired properties, further causing cracks and missing parts in the thin film. As a result, in producing a functional film such as a gas barrier film having a gas barrier layer formed by vacuum deposition or an antireflection film having an antireflection layer formed by vacuum deposition, the resulting product cannot have desired performance, thus leading to a decrease in the yield.

In order to solve such problems, various means for conveying sheets have been proposed.

For example, JP 2000-86032 A discloses a roller (film conveyor roll) which is hollow and has a large number of through holes formed at the peripheral surface of the roller so that air is discharged from the inside of the roller to the outside and which prevents damage to a sheet due to the roller by conveying the sheet in a state in which it is floated from the roller by the discharged air.

A stepped roller is also known which has large-diameter portions at both ends and conveys a sheet with its both ends in the width direction (direction perpendicular to the direction in which the sheet is conveyed) supported by the large-diameter portions.

SUMMARY OF THE INVENTION

Use of the roller disclosed in JP 2000-86032 A can prevent damage to a sheet due to sliding contact between sheet and roller caused by variations in the speed or the pressing force with which the roller presses the sheet.

Since the conveyor roller always discharges air during conveyance of the sheet, the conveyor roller, when used in the above-described vacuum deposition device, may decrease or vary the degree of vacuum or cause gas contaminants to considerably adversely affect film deposition. Therefore, it is extremely difficult to use it in the vacuum deposition device.

In general, both ends of a long sheet are rarely used as part of a product. Therefore, by using a stepped roller so that the central region of a sheet used as a product does not come in contact with the roller, damage to the sheet can be prevented as in the roller disclosed in JP 2000-86032 A.

However, in cases where a stepped roller is used, a wide sheet or a sheet with a large weight has slack or wrinkles in the central region of the sheet (in its width direction) to destabilize conveyance and the sheet may often have damage or deterioration in the surface properties due to contact or sliding contact with the roller.

The present invention has been made to solve the problems as described above, and an object of the present invention is to provide a conveying unit for conveying a long sheet-like subject (sheet) which is capable of considerably reducing damage to the sheet or deterioration of the surface properties due to sliding contact of the sheet with other members or pressing force irrespective of the width and weight of the sheet.

Another object of the present invention is to provide a vacuum deposition device using the conveying unit.

In order to achieve the above objects, the present invention provides a conveying unit for conveying a long sheet-like subject in its longitudinal direction, the conveying unit comprising a stepped roller which has large-diameter portions spaced apart from each other in a direction perpendicular to a direction of conveyance of the sheet-like subject and having a larger diameter than a remainder of the stepped roller being a small-diameter portion of the stepped roller, the large-diameter portions supporting and conveying the sheet-like subject; a closed space forming subunit which forms a closed space between the small-diameter portion of the stepped roller and the sheet-like subject; and a gas supply subunit which supplies a gas to the closed space.

In the conveying unit and vacuum deposition device of the present invention, it is preferred that the closed space forming subunit be a housing which closes a region of the stepped roller around which the sheet-like subject is not wrapped in close contact and that the gas supply subunit supply the gas to the housing. It is also preferred that the closed space forming subunit convey the sheet-like subject by wrapping the sheet-like subject around a substantially whole periphery of the large-diameter portions of the stepped roller and nipping the sheet-like subject with the large-diameter portions, and that the gas supply subunit introduce the gas to the closed space through the small-diameter portion of the stepped roller.

The gas supply subunit preferably supplies an inert gas to the closed space.

The present invention also provides a vacuum deposition device which forms a film on a surface of a long substrate by vacuum deposition as the long substrate is conveyed in its longitudinal direction, the vacuum deposition device comprising a vacuum chamber; a conveying device which conveys the long substrate in its longitudinal direction along a predetermined pathway and which includes a conveying unit; and a film forming unit which forms the film by the vacuum deposition on the long substrate being conveyed by the conveying device, wherein the conveying unit which conveys the long substrate in the longitudinal direction and comprises a stepped roller which has large-diameter portions spaced apart from each other in a direction perpendicular to a direction of conveyance of the long substrate and having a larger diameter than a remainder of the stepped roller being a small-diameter portion of the stepped roller, the large-diameter portions supporting and conveying the long substrate; a closed space forming subunit which forms a closed space between the small-diameter portion of the stepped roller and the long substrate; and a gas supply subunit which supplies a gas to the closed space.

In the vacuum deposition device of the present invention, it is preferred that the film forming unit form the film on the long substrate by a deposition method requiring gas supply and that the gas supply subunit of the conveying unit supply to the closed space at least one gas supplied for film deposition by the film forming unit. The conveying device preferably conveys the long substrate so that the large-diameter portions of the stepped roller of the conveying unit contact a film-forming surface of the long substrate.

The conveying unit of the sheet-like subject (hereinafter simply referred to as the "sheet conveying unit") of the present invention uses a stepped roller, which forms a chamber with a sheet to provide closed space between the stepped roller and the sheet and a gas is introduced into the closed space. Therefore, the present invention can prevent the central region of the sheet to be brought in sliding contact with the roller even if variations in speed or tension occur. The gas is introduced into the space between the stepped roller and the sheet to support the central region of the sheet by the gas pressure and therefore the sheet can be stably conveyed while advantageously preventing sliding contact between the sheet and the roller irrespective of the width and weight of the sheet.

In addition, since the gas is introduced into the closed space formed by using the stepped roller and the sheet, there are extremely few adverse effects on the pressure of the outer space. Accordingly, the conveying unit is also advantageously used in a vacuum deposition device.

The vacuum deposition device of the present invention that uses the sheet conveying unit of the present invention having the features as described above can form a film by vacuum deposition on a substrate having considerably reduced surface damage and deterioration of the properties while also preventing the sliding contact between the conveyor roller and the substrate and the situation in which the conveyor roller presses the substrate during the conveyance of the substrate in the vacuum chamber.

Accordingly, the vacuum deposition device of the present invention can form a proper film while minimizing the deterioration of the crystal growth of the film and occurrence of cracks and missing parts in the film due to the damage to the substrate surface and the deteriorated surface properties, thereby producing a product having the intended performance in a consistent manner.

DETAILED DESCRIPTION OF THE INVENTION

Next, the conveying unit and the vacuum deposition device according to the present invention are described in detail by referring to the preferred embodiments shown in the accompanying drawings.

Figure 1:
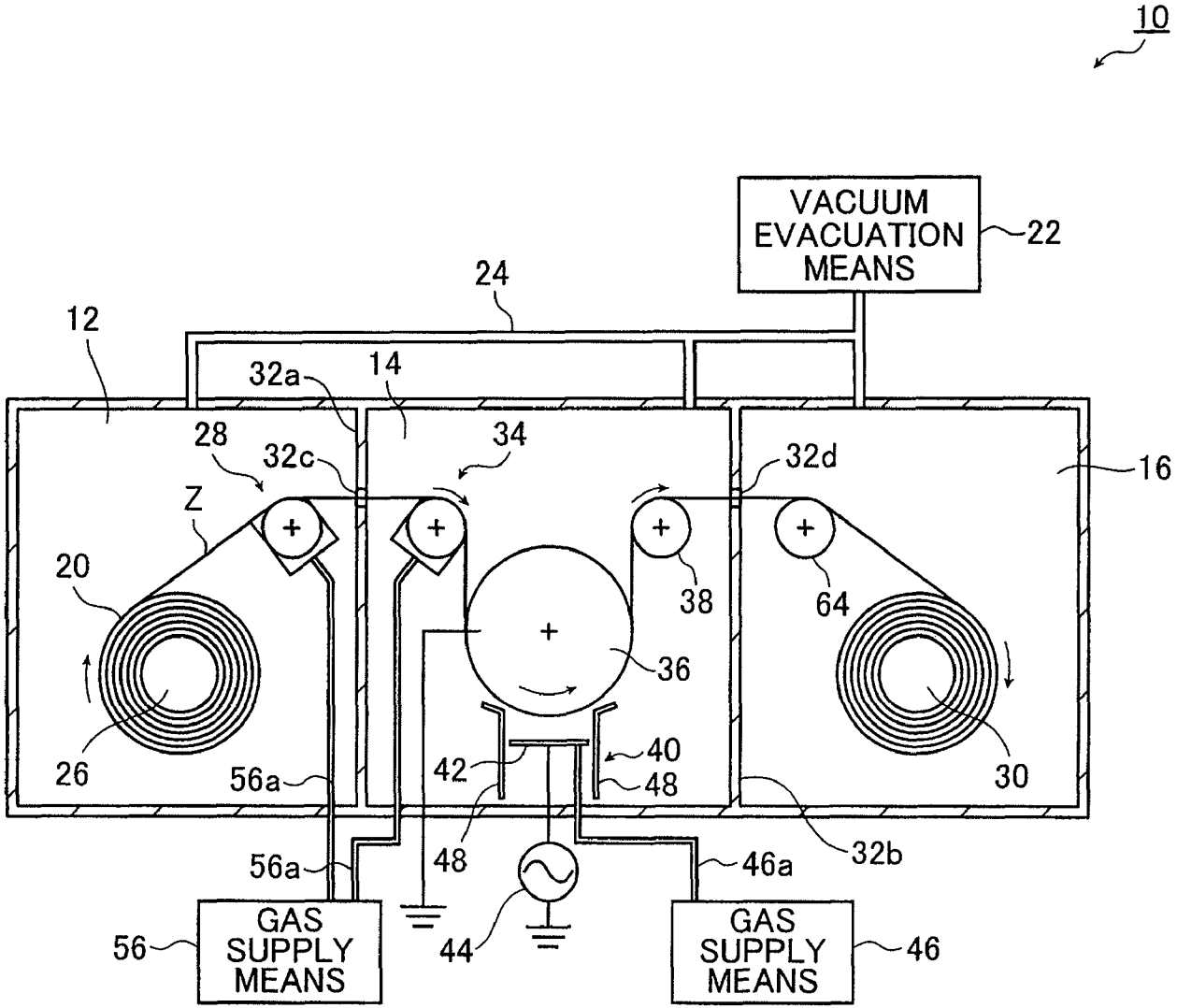
FIG. 1 is a schematic view showing an embodiment of the vacuum deposition device of the present invention.

FIG. 1 schematically shows an embodiment of the vacuum deposition device of the present invention in which the sheet conveying unit of the present invention is used.

A vacuum deposition device (hereinafter referred to as the "deposition device") 10 shown in FIG. 1 is a device in which a film (sheet-like subject) is formed on a substrate Z in the form of a long film strip (starting film material) by vacuum deposition (by capacitively coupled plasma-enhanced chemical vapor deposition (hereinafter abbreviated as "CCP-CVD") in the illustrated embodiment). The deposition device 10 includes a feed chamber 12, a film deposition chamber 14 and a take-up chamber 16.

The deposition device 10 is a device in which a film is deposited by the so-called "roll-to-roll" system as described above. In this device, the substrate Z in the form of a long film strip is fed from a substrate roll 20 having the substrate Z wound into a roll and conveyed in its longitudinal direction while a film is deposited (formed) on the substrate Z, and the substrate Z having the film formed thereon is wound into a roll.

The deposition device 10 includes a vacuum evacuation means 22, and an evacuation line 24 that connects the vacuum evacuation means 22 with the feed chamber 12, the film deposition chamber 14 and the take-up chamber 16.

The vacuum evacuation means 22 evacuates the feed chamber 12, the film deposition chamber 14 and the take-up chamber 16 through the evacuation line 24 and the feed chamber 12, the film deposition chamber 14 and the take-up chamber 16 are maintained at a predetermined degree of vacuum (pressure) appropriate for film deposition on the substrate Z.

The vacuum evacuation means 22 in the deposition device 10 of the present invention is not particularly limited, and exemplary means that may be used include vacuum pumps such as a turbo pump, a mechanical booster pump and a rotary pump, an assist means such as cryogenic coil, and various other known vacuum evacuation means which use a means for adjusting the ultimate degree of vacuum or the amount of discharge air and are employed in vacuum deposition devices.

The feed chamber 12 includes a rotary shaft 26 and a conveying unit 28.

In the deposition device 10, the substrate roll 20 having the substrate Z in the form of a long film strip wound into a roll is mounted on the rotary shaft 26 of the feed chamber 12.

Once the substrate roll 20 is mounted on the rotary shaft 26, the substrate Z is fed from the substrate roll 20 and conveyed along a predetermined pathway along which the substrate Z travels from the feed chamber 12 through the film deposition chamber 14 to a winding shaft 30 of the take-up chamber 16. In the deposition device 10, the feed of the substrate Z from the substrate roll 20 and the winding of the functional film on the winding shaft 30 are carried out in synchronism so that the substrate Z in the form of a long film strip is conveyed in its longitudinal direction along the predetermined pathway while continuously depositing on the substrate.

In the deposition device 10 of the present invention, the substrate Z is not particularly limited, and any substrate (base film) may be used as long as a film can be deposited by vacuum deposition techniques such as CVD and sputtering. Examples of such substrate include resin films (plastic films) such as PET films and metal sheets such as aluminum sheets. The substrate Z used may be the one having a film such as a protective film or an adhesive film formed on its surface.

In addition to the above-described sheets that can be used for the substrate, the sheet conveying unit of the present invention may convey any type of sheet as long as it is long.

In the feed chamber 12, the rotary shaft 26 is rotated by a drive source (not shown) in a clockwise direction in FIG. 1 so that the substrate Z is fed from the substrate roll 20 and guided by the conveying unit 28 along the predetermined pathway to be conveyed to the film deposition chamber 14. The conveying unit 28 is a unit for conveying a sheet in the present invention. The conveying unit 28, that is, the conveying unit of the present invention is described later in further detail.

As described above, the vacuum evacuation means 22 is connected to the feed chamber 12 through the evacuation line 24 so that the feed chamber 12 is evacuated to a predetermined degree of vacuum (pressure) appropriate for the film forming pressure in the film deposition chamber 14 whereby the internal pressure of the feed chamber 12 is prevented from adversely affecting the film deposition in the film deposition chamber 14.

A film is deposited (formed) on the surface of the substrate Z in the film deposition chamber 14 by CCP-CVD. In the illustrated embodiment, the film deposition chamber 14 includes a conveying unit 34, a drum 36, a guide roller 38 and a film forming means 40.

The substrate Z is conveyed to the film deposition chamber 14 through a slit 32*c* formed in a separation wall 32*a* between the feed chamber 12 and the film deposition chamber 14.

In a preferred embodiment, the illustrated deposition device 10 also evacuates the feed chamber 12 and the take-up chamber 16 in accordance with the film forming pressure in the film deposition chamber 14. However, this is not the sole case of the present invention, and for example, instead of evacuating the feed chamber 12 and the take-up chamber 16, the film deposition chamber 14 may be made substantially airtight by forming slits having the minimum size which allows the substrate Z to pass through the slits without contacting them. Alternatively, instead of evacuating the feed chamber 12 and the take-up chamber 16, a subchamber through which the substrate Z passes may be provided between the feed chamber 12 and the film deposition chamber 14 and between the film deposition chamber 14 and the take-up chamber 16 and evacuated by a vacuum pump.

The drum 36 of the film deposition chamber 14 is a cylindrical member which rotates around the central axis in a counterclockwise direction in FIG. 1.

The substrate Z fed from the feed chamber 12 is conveyed by the conveying unit 34 along the predetermined pathway, wrapped around a predetermined region of the peripheral surface of the drum 36, supported by the drum 36 and conveyed along the predetermined pathway while a predetermined film is deposited by the film forming means 40. Then, the substrate Z having the film formed thereon is guided by the guide roller 38 along the predetermined pathway to be conveyed to the take-up chamber 16.

The conveying unit 34 is an embodiment of the sheet conveying unit in the present invention. The conveying unit 34, that is, the conveying unit of the present invention is described later in further detail.

As described above, the film deposition chamber 14 is used to form a film on the surface of the substrate Z by CCP-CVD. Therefore, the film forming means 40 carries out film deposition by CCP-CVD and includes a shower head electrode 42, an RF power supply 44, a gas supply means 46 and two partitions 48.

The shower head electrode 42 is a hollow casing which is rectangular in section and is made of a conductive material with its maximum surface facing the drum 36.

The shower head electrode 42 has a large number of through holes formed at its whole surface facing the drum 36 at a uniform density. The gas supply means 46 (a gas supply pipe 46*a* thereof) is connected to the inner space of the shower head electrode 42.

The gas supply means 46 supplies to the shower head electrode 42 a reactive gas for use in film deposition on the substrate Z and other necessary gases than the reactive gas such as argon gas. Therefore, the gases supplied by the gas supply means 46 are charged into the film deposition space between the drum 36, that is, the substrate Z and the shower head electrode 42 through the through holes formed at the surface of the shower head electrode 42 facing the drum 36.

Use may be made of any known gas supply means employed in various vacuum deposition devices such as a gas supply source and a flow rate adjusting means.

The RF power supply 44 is a known RF power supply employed in plasma CVD devices and applies a predetermined RF voltage to the shower head electrode 42.

In the illustrated film deposition chamber 14, the drum 36 is grounded so that it functions as a counter electrode of the shower head electrode 42. Alternatively, the drum 36 may be also connected to the RF power supply.

The two partitions 48 are plate members whose upper ends reach the vicinity of the surface of the drum 36 and which are provided so as to sandwich the shower head electrode 42 therebetween in the direction of conveyance of the substrate Z.

The partitions 48 are members for defining the substantial film deposition region in the direction of conveyance of the substrate Z so that the gases charged from the shower head electrode 42 are prevented from diffusing over the region where the gases are not necessary.

In the film forming means 40, during film deposition on the surface of the substrate Z, the RF power supply 44 applies an RF voltage to the shower head electrode 42, and the gas supply means 46 supplies to the shower electrode 42 a reactive gas and another gas, which are then introduced between the shower head electrode 42 and the substrate Z.

In this way, the reactive gas is excited to generate plasma to thereby carry out film deposition on the surface of the substrate Z by plasma CVD.

The vacuum deposition device of the present invention is not limited to one that carries out film deposition by CCP-CVD, and any vacuum deposition (vapor-phase deposition) techniques known in the art such as plasma CVD processes other than CCP-CVD as exemplified by ICP-CVD (inductively coupled plasma CVD), sputtering, CVD, ion plating, and vacuum evaporation may be used.

In terms of the properties of the sheet conveying unit of the present invention to be described later, vacuum deposition techniques that require gas supply as exemplified by the various CVD processes and sputtering are advantageously used.

As described above, the conveying unit 28 of the feed chamber 12 and the conveying unit 34 of the film deposition chamber 14 are both units for conveying a sheet in the present invention.

Figure 2B:
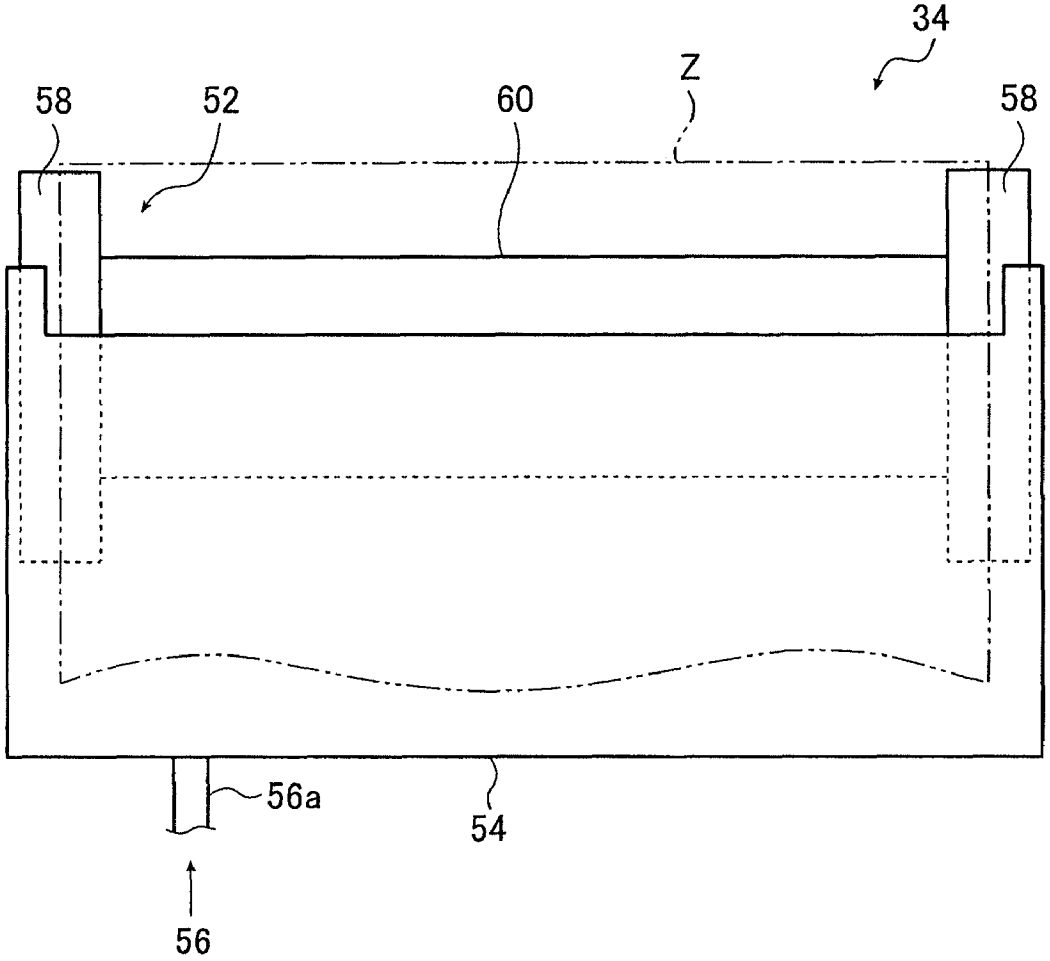
FIG. 2B is a side view of the conveying unit shown in FIG. 2A.
Figure 2A:
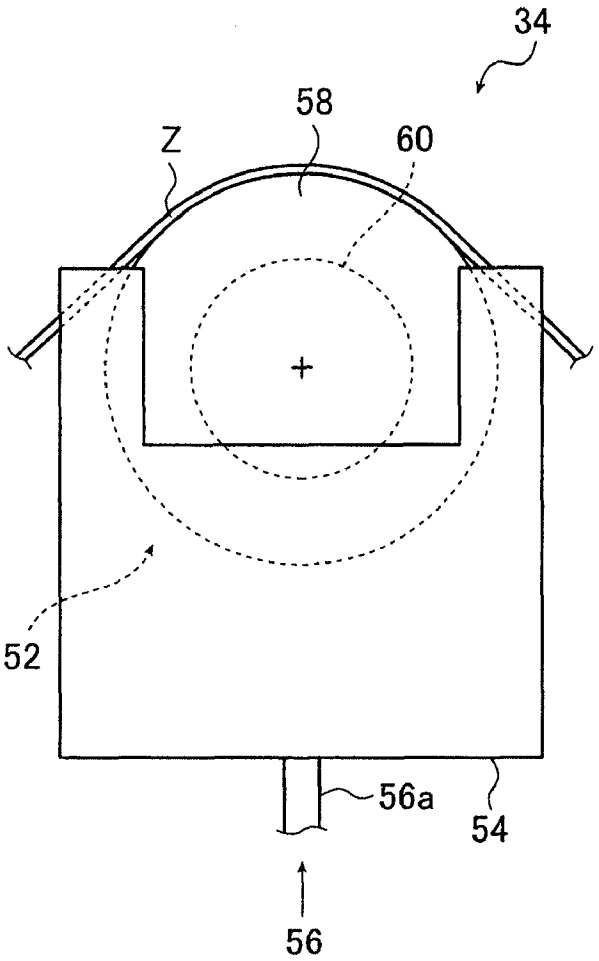
FIG. 2A is a front view schematically showing an embodiment of the conveying unit of the present invention that may be used in the vacuum deposition device shown in FIG. 1.

FIGS. 2A and 2B schematically show the conveying unit 34 of the film deposition chamber 14 as an embodiment of the conveying unit of the present invention. The conveying unit 28 of the feed chamber 12 (and the other conveying units in this embodiment) are basically configured in the same manner as shown in FIGS. 2A and 2B except that the region where the stepped roller is covered with a housing and the shape of the housing are only different in accordance with the region of the stepped roller around which the substrate Z is wrapped and the region of the stepped roller around which the substrate Z is not wrapped.

FIG. 2A is a front view (a view seen from the same direction as FIG. 1) and FIG. 2B is a side view (a view seen from the direction of conveyance of the substrate Z). FIG. 2B shows the substrate Z by chain lines in order to clarify the structure.

The conveying unit 34 conveys the substrate Z from the horizontal direction to the vertical direction in FIG. 1, so the conveying unit 34 shown in FIG. 2A is rotated by about 45° in a clockwise direction.

As shown in FIGS. 1, 2A and 2B, the conveying unit 34 includes a stepped roller 52, a housing 54 and a gas supply means 56.

The stepped roller 52 is a conveyor roller having at both ends large-diameter portions which are larger in diameter than the other region and rotates in accordance with the speed at which the substrate Z is conveyed. The region between the large-diameter portions 58 is hereinafter referred to as a small-diameter portion 60. Alternatively, the stepped roller 52 may be a driven roller.

The stepped roller 52 supports both the ends of the substrate Z on the large-diameter portions 58 in accordance with the pathway along which the substrate Z is conveyed, and guides and conveys the substrate Z along the predetermined pathway toward the drum 36. It is to be noted here that the ends of the substrate Z refer to those in the width direction of the substrate Z, in other words, those in a direction perpendicular to the direction of conveyance.

Therefore, the substrate Z comes in contact with and is supported and conveyed by the large-diameter portions 58 of the stepped roller 52 in the conveying unit 34. The substrate Z does not contact the small-diameter portion 60.

In the present invention, a nip roller for nipping and conveying the substrate Z with the large-diameter portions 58 may be further provided to more stabilize the conveyance of the substrate Z.

Both ends of the substrate Z contact the large-diameter portions 58 of the stepped roller 52. Therefore, these regions of the substrate Z come in sliding contact with the stepped roller 52 due to variations in the conveying speed and tension. When pressed by the large-diameter portions 58, the substrate Z may have damage or deteriorated surface properties.

In general, a long sheet and more specifically the substrate Z on the surface of which a film adequate for the intended use is formed is not used for the whole part as a product, and the portions in the vicinities of the film ends are cut in accordance with the product size, or may very often do not need to exhibit the intended functions even if they are used. In other words, the ends of the long sheet, that is, the ends of the substrate Z have no problem as the product even if the performance and the properties are deteriorated or lowered at these ends.

In other words, the sheet conveying unit of the present invention preferably conveys the sheet (substrate Z) as a product with the large-diameter portions of the stepped roller contacting the regions to be removed or the ends which do not need to serve (function) as the product.

The housing 54 forms closed space between the small-diameter portion 60 of the stepped roller 52 and the substrate Z (closed space including the recess of the stepped roller 52).

In other words, the housing 54 covers and closes the region (open region) of the stepped roller 52 around which the substrate Z is not wrapped in close contact to thereby form a chamber (compartment) with the stepped roller 52 and the substrate Z. The closed space including the space between the small-diameter portion 60 and the substrate Z is thus formed.

In the present invention, it is basically preferable for the housing 54 to form completely sealed space with the stepped roller 52 and the substrate Z. However, since the stepped roller 52 rotates and the substrate Z is conveyed, the completely sealed space cannot be formed without causing damage to the stepped roller 52 and the substrate Z. In other words, it is very difficult to form the completely sealed space with the housing 54.

Therefore, in the present invention, the closed space the housing 54 (means for forming the closed space in the present invention) forms in conjunction with the stepped roller 52 and the substrate Z may be substantially closed space which is not completely sealed. More specifically, space between the small-diameter portion 60 and the substrate Z may be wholly enclosed by the housing 54, the stepped roller 52 and the substrate Z so that the central region of the substrate Z can be properly supported by the pressure of the gas supplied into the closed space as described later. The closed space formed by the housing 54, the stepped roller 52 and the substrate Z is preferably substantially closed space which include the space between the small-diameter portion 60 and the substrate Z and closes other portions than the gaps necessary to stably and safely carry out rotation of the stepped roller 52 and conveyance of the substrate Z.

The gas supply means 56 is connected to the inside of the housing 54 through a gas supply pipe 56*a* and supplies a gas to the closed space formed by the housing 54.

As in the gas supply means 46, the gas supply means 56 may also be of any known type.

The conveying unit 34 of the present invention is configured as follows: The stepped roller 52 is used as the means for conveying the substrate Z; the region of the stepped roller 52 around which the substrate Z is not wrapped in close contact is closed by the housing 54; closed space including the space between the substrate Z and the small-diameter portion 60 is formed by the housing 54, the stepped roller 52 and the substrate Z; and a gas is introduced into the closed space to prevent damage to the substrate Z or deterioration of the surface properties due to conveyance of the substrate Z.

As described above, the conveyor rollers are used to convey the substrate Z in the form of a long film strip (sheet), but the surface of the substrate Z may often be damaged by the rotational speed of the rollers and the variations in the conveyance of the substrate Z. In cases where a flexible organic film or the like is formed on the surface of the substrate Z, damage to the surface of the substrate Z or deterioration of the surface properties may also occur due to pressing force with which the conveyor rollers press the sheet. Particularly in cases where an organic film is formed on the surface of the substrate Z, variations in the film properties such as softening may also occur in vacuum. In such cases, damage to the surface of the substrate Z and deterioration of the surface properties due to conveyance in vacuum raise a serious problem in the illustrated deposition device 10.

As also described above, such damage to the sheet surface and deterioration of the surface properties cause light scattering in an optical film, and deterioration in the quality of the film formed as well as cracks and missing parts of the film in the substrate Z subjected to vacuum deposition as in the illustrated embodiment.

In view of this, the conveying unit 34 of the present invention uses the stepped roller 52 to support the ends of the substrate Z at the large-diameter portions 58 of the stepped roller 52, uses the housing 54 to form the closed space including the space between the substrate Z and the small-diameter portion 60, and also uses the gas supply means 56 to supply a gas to the closed space.

Therefore, in the conveying unit 34 of the present invention, the substrate Z contacts the stepped roller 52 only at the ends thereof and the central region that serves as a product does not contact the stepped roller 52. The gas is supplied to the closed space to enable the central region of the substrate Z not supported by the large-diameter portions 58 to be supported by the gas pressure (differential pressure between the closed space and the outside), whereby even the substrate Z with a large width or the substrate Z with a large weight can be prevented from having slack or wrinkles in the central region. The substrate Z can be stably conveyed and damage to the substrate Z and deterioration of the surface properties can be advantageously prevented from occurring by contact or sliding contact between the central region of the substrate Z and the roller due to the slack and pressing force with which the roller presses the substrate Z.

Since the substrate Z is supported by supplying a gas to the thus formed closed space including the space between the substrate Z and the small-diameter portion 60, the amount of gas supplied can be reduced and there are few adverse effects of the pressure on the outside. Therefore, the present invention can be advantageously used in the illustrated deposition device 10 as well.

In addition, the deposition device 10 of the present invention that employs the conveying unit 34 of the present invention is capable of consistently producing, by vacuum deposition, a proper film having no reduced film quality, film cracks or missing parts due to damage to the substrate Z and deterioration of the surface properties. In other words, the illustrated deposition unit 10 applies the conveying unit of the present invention to the conveyor means which contacts the film forming surface in vacuum to thereby achieve consistent formation of a proper film by vacuum deposition while advantageously preventing damage to the film forming surface and deterioration of the surface properties, thus enabling a product having the intended performance to be consistently produced.

The amount of gas supplied by the gas supply means 56 of the conveying unit 34 of the present invention is not particularly limited but may be appropriately set depending on the size of the closed space formed by the housing 54 and the like, the outside pressure, and the width and weight of the substrate Z so that the central region of the substrate Z may be properly supported by the gas pressure in the closed space without causing slack.

In the present invention, the gas supply means 56 may introduce various gases such as air and nitrogen gas into the closed space as long as the gas used does not adversely affect the substrate Z as well as the stepped roller 52 and the housing 54. In consideration of the impact on the ambient environment, inert gases such as nitrogen gas and argon gas are preferably used.

The gas supply means 56 may introduce one or more gases into the closed space.

In cases where the conveying unit 34 is used in a vacuum deposition device as in the illustrated embodiment, in other words, in the deposition device 10 of the present invention, the gas supply means 56 preferably introduces one or more gases for use in forming a film on the substrate Z into the closed space. For example, in cases where the deposition device 10 carries out film deposition on the substrate Z by CCP-CVD in which silane gas, ammonia gas and nitrogen gas are supplied, the gas supply means 56 preferably supplies nitrogen gas to the closed space. In cases where sputtering in which argon gas is supplied is carried out in the deposition device employing the conveying unit of the present invention, the gas supply means of the conveying unit of the present invention preferably supplies argon gas to the closed space.

Having such a structure enables adverse effects of the gas supply to the closed space of the conveying unit 34 on film deposition to be significantly reduced.

As described above, the substrate Z on which a film has been formed in the film deposition chamber 14 of the deposition device 10 shown in FIG. 1 is guided by the guide roller 38 to be conveyed to the take-up chamber 16 through a slid 32*d* formed in a separation wall 32*b* between the film deposition chamber 14 and the take-up chamber 16.

The take-up chamber 16 includes the winding shaft 30 and a guide roller 64.

The substrate Z having the film deposited thereon in the film deposition chamber 14 and conveyed therefrom is guided by the guide roller 64 to be conveyed to the winding shaft 30, where the substrate Z is wound into a roll.

The vacuum evacuation means 22 is connected not only to the feed chamber 12 but also to the take-up chamber 16 through the evacuation line 24 so that the take-up chamber 16 is evacuated to a degree of vacuum appropriate for the film forming pressure in the film deposition chamber 14 whereby the internal pressure of the take-up chamber 16 is prevented from adversely affecting the internal pressure of the film deposition chamber 14.

The illustrated deposition device 10 uses the conveying unit of the present invention only in the conveying units 28 and 34, which are conveying means that come in contact with the film forming surface of the substrate upstream of the drum 36 where film deposition is carried out.

However, the vacuum deposition device of the present invention is not particularly limited to this embodiment, and the conveying unit of the present invention may be used for all the conveying means that come in contact with the film forming surface. Alternatively, in cases where the surface of the film formed is to be protected, the conveying unit of the present invention may only be applied to the conveying means that come in contact with the film forming surface downstream of the drum 36 (film deposition region). In addition, in cases where the rear surface of the substrate Z which is opposite to the surface on which a film is deposited is to be protected, the conveying unit of the present invention may be applied to the conveying means that come in contact with the rear surface of the substrate Z.

The conveying unit 34 (28) of the present invention shown in FIGS. 1, 2A and 2B forms the closed space between the stepped roller 52 and the substrate Z by using the housing that closes the open space between the stepped roller 52 and the substrate Z which is not wrapped around the stepped roller 52 in close contact. However, this is not the sole case of the present invention and various arrangements may be used.

Figure 3:
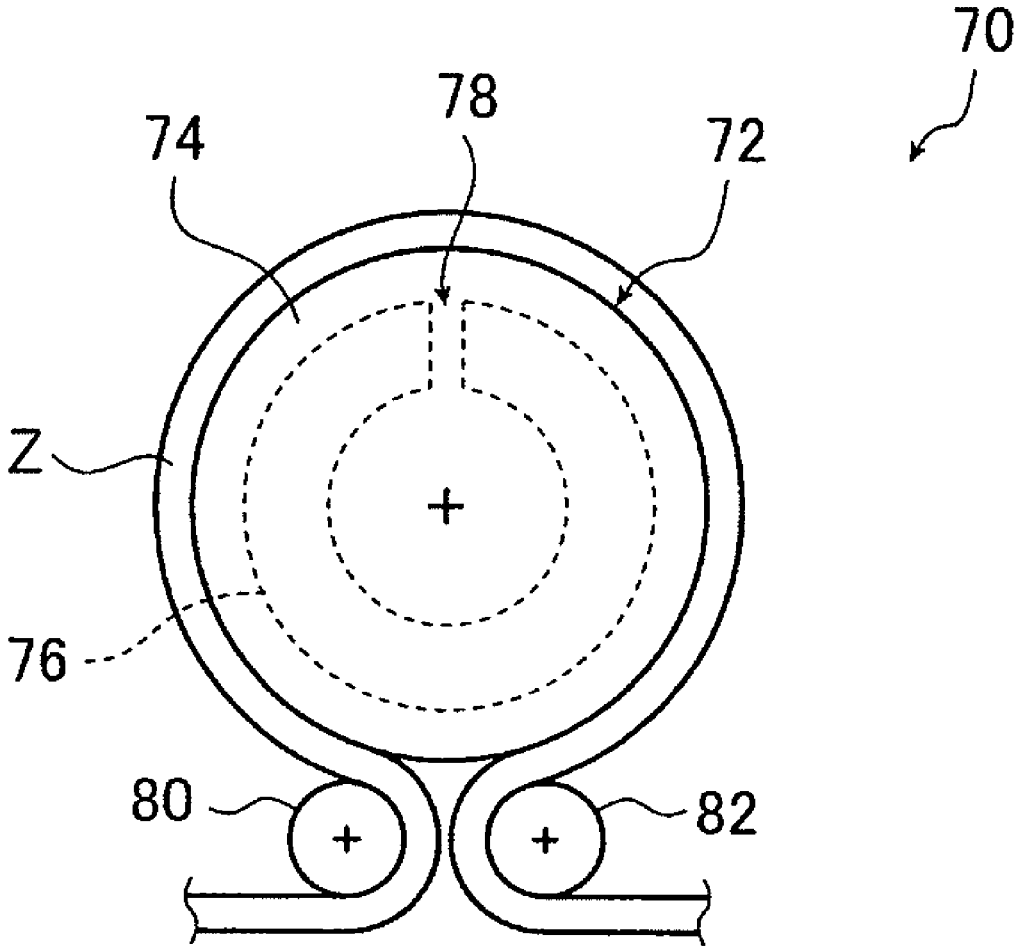
FIG. 3 is a schematic view showing another embodiment of the conveying unit of the present invention.

Another embodiment is conceptually shown in FIG. 3.

A conveying unit 70 also uses a stepped roller 72 having large-diameter portions 74 at both ends of the stepped roller 72 so that the substrate Z in the form of a long film strip is conveyed and guided in a predetermined direction with its both ends wrapped around the large-diameter portions 74.

The stepped roller 72 has a hollow small-diameter portion 76 and a through hole 78 extends through the small-diameter portion 76. Although not shown in FIG. 3, the gas supply means 56 is also connected to the inside of the small-diameter portion 76 for gas supply.

The conveying unit 70 uses two rollers including a first roller 80 and a second roller 82 as the means for forming (substantially) closed space between the substrate Z and the small-diameter portion 76.

The first roller 80 and the second roller 82 are nip rollers that cooperate with the large-diameter portions 74 of the stepped roller 72 to nip and convey the substrate Z. As shown in FIG. 3, the substrate Z conveyed to the conveying unit 70 is guided by the first roller 80, wrapped around the large-diameter portions 74 and conveyed, then guided by the second roller 82 and moved away from the large-diameter portions 74 to be conveyed in a predetermined direction. In other words, the substrate Z is wrapped around the large-diameter portions 74 of the stepped roller 72 during the travel between the first roller 80 and the second roller 82.

The first roller 80 and the second roller 82 are disposed in the closest possible manner in such a state that the substrate Z to be conveyed to the stepped roller 72 and the substrate Z to be moved away from the stepped roller 72 are not brought in contact with each other. Therefore, the substrate Z is wrapped around the substantially whole peripheries of the large-diameter portions 74.

That is, the conveying unit 70 uses the two nip rollers for nipping the substrate Z with the stepped roller 72 to wrap the substrate Z around the substantially whole peripheries of the large-diameter portions 74 of the stepped roller 72 to thereby close the space between the substrate Z and the small-diameter portion 76 with the stepped roller 72 and the substrate Z. In other words, this embodiment forms the chamber only with the stepped roller 72 and the substrate Z to close the space formed in the recess of the stepped roller 72.

As described above, the gas is supplied from the gas supply means 56 to the space between the substrate Z and the small-diameter portion 76 through the small-diameter portion 76 of the stepped roller 72. Since the through hole 78 is formed in the small-diameter portion 76, the gas is supplied to the closed space formed between the stepped roller 72 and the substrate Z.

In the conveying unit 70 as well, both the ends of the substrate Z only contact the large-diameter portions 74 of the stepped roller 72 and the central region is supported by the gas pressure in the closed space, and therefore the substrate Z can be stably conveyed without causing damage to the substrate Z, deterioration of the surface properties or slack in the central region.

This conveying unit can also be advantageously used in the vacuum deposition device, because the gas is introduced into the closed space between the substrate Z and the small-diameter portion 76.

The nip roller used in the conveying unit of the present invention as shown in FIG. 3 is not the sole member for nipping and conveying the substrate Z (sheet) together with the large-diameter portions 74 of the stepped roller 72, and a nip belt for nipping the substrate Z together with the large-diameter portions 74 may also be used.

In the above-described embodiments, the sheet conveying unit of the present invention is applied to a vacuum deposition device for conveying a substrate, but the sheet conveying unit of the present invention is not limited to this but may be applied to various applications for conveying various kinds of sheet, as exemplified by conveyance of a film in a device for winding a long plastic film as long as a long sheet is used and the conveying unit can support the long sheet by the gas pressure.

What is claimed is:

1. A conveying unit for conveying a long sheet-like subject in its longitudinal direction, said conveying unit comprising:

a stepped roller which has large-diameter portions spaced apart from each other in a direction perpendicular to a direction of conveyance of the sheet-like subject and having a larger diameter than a remainder of said stepped roller being a single, continuous-surface, small-diameter portion of said stepped roller, said large-diameter portions supporting and conveying said sheet-like subject;

a closed space forming subunit which forms a closed space between said small-diameter portion of said stepped roller and said sheet-like subject; and a gas supply subunit which supplies a gas to said closed space.

2. The conveying unit according to claim 1, wherein said closed space forming subunit is a housing which closes a region of said stepped roller around which said sheet-like subject is not wrapped in close contact and said gas supply subunit supplies the gas to said housing.

3. The conveying unit according to claim 1, wherein said closed space forming subunit conveys said sheet-like subject by wrapping said sheet-like subject around a substantially whole periphery of said large-diameter portions of said stepped roller and nipping said sheet-like subject with said large-diameter portions, and said gas supply subunit introduces the gas to said closed space through said small-diameter portion of said stepped roller.

4. The conveying unit according to claim 1, wherein said gas supply subunit supplies an inert gas to said closed space.

5. A vacuum deposition device which forms a film on a surface of a long substrate by vacuum deposition as the long substrate is conveyed in its longitudinal direction, said vacuum deposition device comprising:

a vacuum chamber;

a conveying device which conveys said long substrate in its longitudinal direction along a predetermined pathway and which includes a conveying unit; and a film forming unit which forms the film by the vacuum deposition on the long substrate being conveyed by said conveying device, wherein said conveying unit which conveys the long substrate in the longitudinal direction and comprises:

a stepped roller which has large-diameter portions spaced apart from each other in a direction perpendicular to a direction of conveyance of the long substrate and having a larger diameter than a remainder of said stepped roller being a single, continuous-surface, small-diameter portion of said stepped roller, said large-diameter portions supporting and conveying said long substrate;

a closed space forming subunit which forms a closed space between said small-diameter portion of said stepped roller and the long substrate; and a gas supply subunit which supplies a gas to said closed space.

6. The vacuum deposition device according to claim 5, wherein said film forming unit forms the film on said long substrate by a deposition method requiring gas supply and said gas supply subunit of said conveying unit supplies to said closed space at least one gas supplied for film deposition by said film forming unit.

7. The vacuum deposition device according to claim 5, wherein said conveying device conveys said long substrate so that the large-diameter portions of the stepped roller of said conveying unit contact a film-forming surface of said long substrate.

8. The vacuum deposition device according to claim 5, wherein said closed space forming subunit of said conveying unit is a housing which closes a region of said stepped roller around which said long substrate is not wrapped in close contact and said gas supply subunit supplies the gas to said housing.

9. The vacuum deposition device according to claim 5, wherein said closed space forming subunit of said conveying unit conveys said long substrate by wrapping said long substrate around a substantially whole periphery of said large-diameter portions of said stepped roller and nipping said long substrate with said large-diameter portions, and said gas supply subunit introduces the gas to said closed space through said small-diameter portion of said stepped roller.

10. The vacuum deposition device according to claim 5, wherein said gas supply subunit of said conveying unit supplies an inert gas to said closed space.

11. The conveying unit according to claim 1, wherein said large-diameter portions of said stepped roller contacts said sheet-like subject at regions to be removed or ends which do not need to serve as product and conveys said sheet-like subject.

12. The conveying unit according to claim 5, wherein said large-diameter portions of said stepped roller of said conveying device contacts said sheet-like subject at regions to be removed or ends which do not need to serve as product and conveys said sheet-like subject.

* * * * *